US006561682B1

(12) United States Patent
Juang

(10) Patent No.: US 6,561,682 B1
(45) Date of Patent: May 13, 2003

(54) KNOCKDOWN LAMPSHADE STRUCTURE

(76) Inventor: Mei-Ju Juang, No. 2, Alley 5, Lane 37, Shin Shing Street, Shulin City, Taipei (TW)

( * ) Notice: Subject to any disclaimer, the term of this patent is extended or adjusted under 35 U.S.C. 154(b) by 0 days.

(21) Appl. No.: 10/023,414

(22) Filed: Dec. 21, 2001

(51) Int. Cl.[7] ..... F21V 1/06
(52) U.S. Cl. ..... 362/352; 362/358
(58) Field of Search ..... 362/351, 278, 362/357, 358, 359, 367, 410, 433, 442, 450, 434, 352

(56) References Cited

U.S. PATENT DOCUMENTS 4,751,625 A * 6/1988 Lin ..... 362/276
4,841,424 A * 6/1989 Weber ..... 362/352
5,375,048 A * 12/1994 Barnes ..... 362/352
6,386,739 B1 * 5/2002 Wu ..... 362/351
6,439,747 B1 * 8/2002 Liu et al. ..... 362/352
6,443,599 B1 * 9/2002 Wu ..... 362/351

* cited by examiner

*Primary Examiner*—Sandra O'Shea
*Assistant Examiner*—Hargobind S. Sawhney
(74) *Attorney, Agent, or Firm*—Bacon & Thomas

(57) ABSTRACT

Knockdown lampshade structure including a frame body, a shade body and a circular frame. The frame body is embraced with multiple arch metal frames handed in glove by multiple joints. The lamp stand is attached to the arch metal frame to stabilize lamp base and light bulb. The shade body is in fan-shaded rolled into conic shape which is made of soft fabric outside and hard paper material inside. The hooks are integrally sewn to the shade body across the top and bottom end where embedded with the circular frame and metal frames. The clips are spreading evenly across the shade body edge to embrace the shade body hence from the conic shape. The circular frame is made from metal, embedded with the hooks on the top end to support the shade body. The lampshade can be minimized to facilitate storage and transfer of large amount of products, hence minimize the occupied space and cut down the overheads.

2 Claims, 7 Drawing Sheets

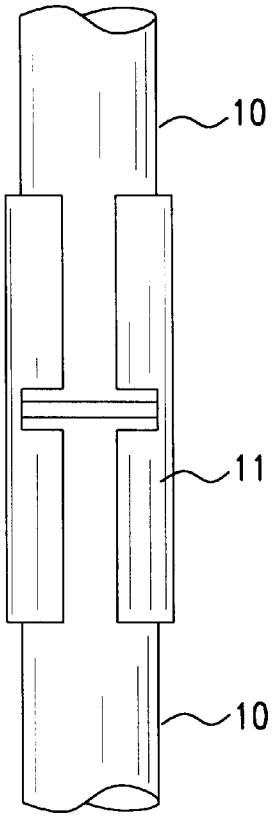
FIG.3-A
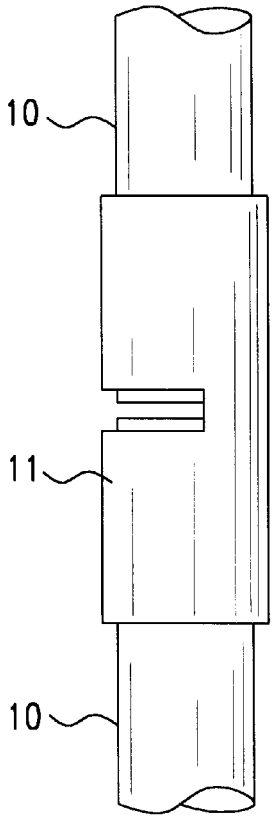
FIG.3-B

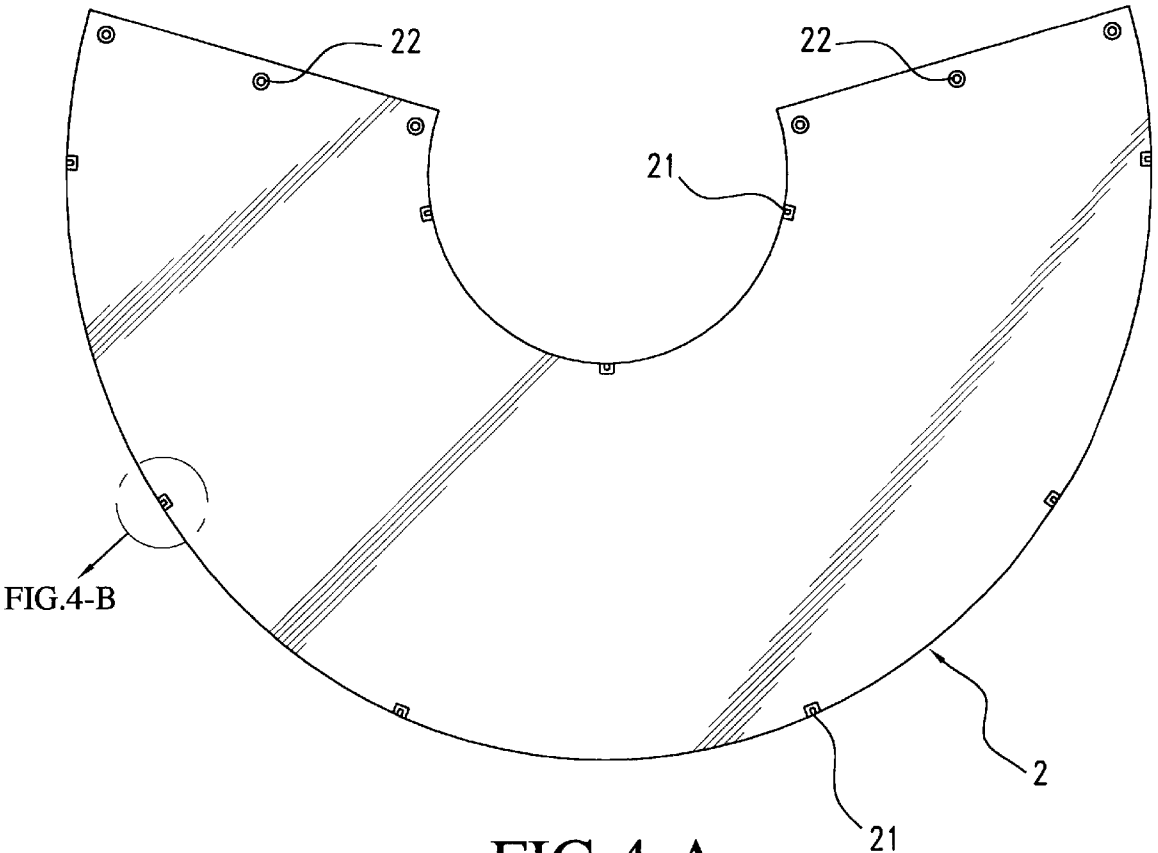
FIG.4-A
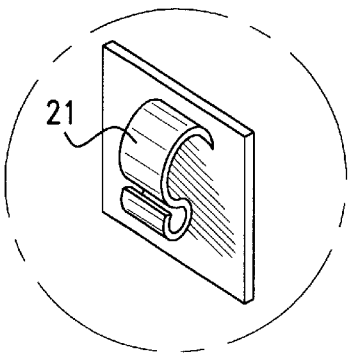
FIG.4-B

KNOCKDOWN LAMPSHADE STRUCTURE

BACKGROUND OF THE INVENTION

The present invention is related to an improved lamp shade structure, and more particularly to a knockdown lamp shade structure which can be easily assembled and disassembled to minimize the volume of the lamp shade so to facilitate storage and transfer of large amount of products, hence minimize the required space and cut down the production overheads.

A conventional lampshade structure includes a frame body and a shade body embracing the frame body for concentrating light beam and enhancing illuminating effect. In order to have sufficient structural strength and ensure safety, the conventional frame body is generally made of metal rids which are cut into a certain length and welded with each other to form the frame body. The shade body is made of a sheet of fabric or paper material and embraces the frame body to form the lamp structure.

Such frame body has rigid structure. However, after welded, the frame body cannot be disassembled and will occupy much room. Therefore, when storing or transferring a large amount of products, very much room will be occupied to lead to great inconvenience in storage and transfer. This results in increased cost and is not economic.

Whereas the present invention the knockdown lamp structure. The frame body is embraced with multiple arch metal frames handed in glove by multiple joints. The lamp stand is attached to the arch metal frames to from the frame body. The shade body is in fan-shaded rolled into conic shape which is made of soft fabric outside and hard paper material inside. The shade body is embedded with multiple hook alone the top and bottom end, allows easy assemble and disassemble with the frame body and the circular frame. The shade body is packed in a flat form when storing and transferring hence minimized the occupied volume.

The assembly of the frame body and circular frame is sewn by multiple joints and hooks. Such assembly allows a fast, simple and effective storage and transfer hence meet the objectives of minimize the required space and cut down the overheads.

The present invention can be best understood through the following description and accompanying drawings wherein:

BRIEF DESCRIPTION OF THE DRAWINGS

FIG. 3 is a partially exploded view of the arch metal frame and joints of the present invention.

FIG. 4A shows an embodiment of the shade body of the present invention.

FIG. 4B shows an embodiment of the hook of the present invention.

DETAILED DESCRIPTION OF THE PREFERRED EMBODIMENT

Figure 1:
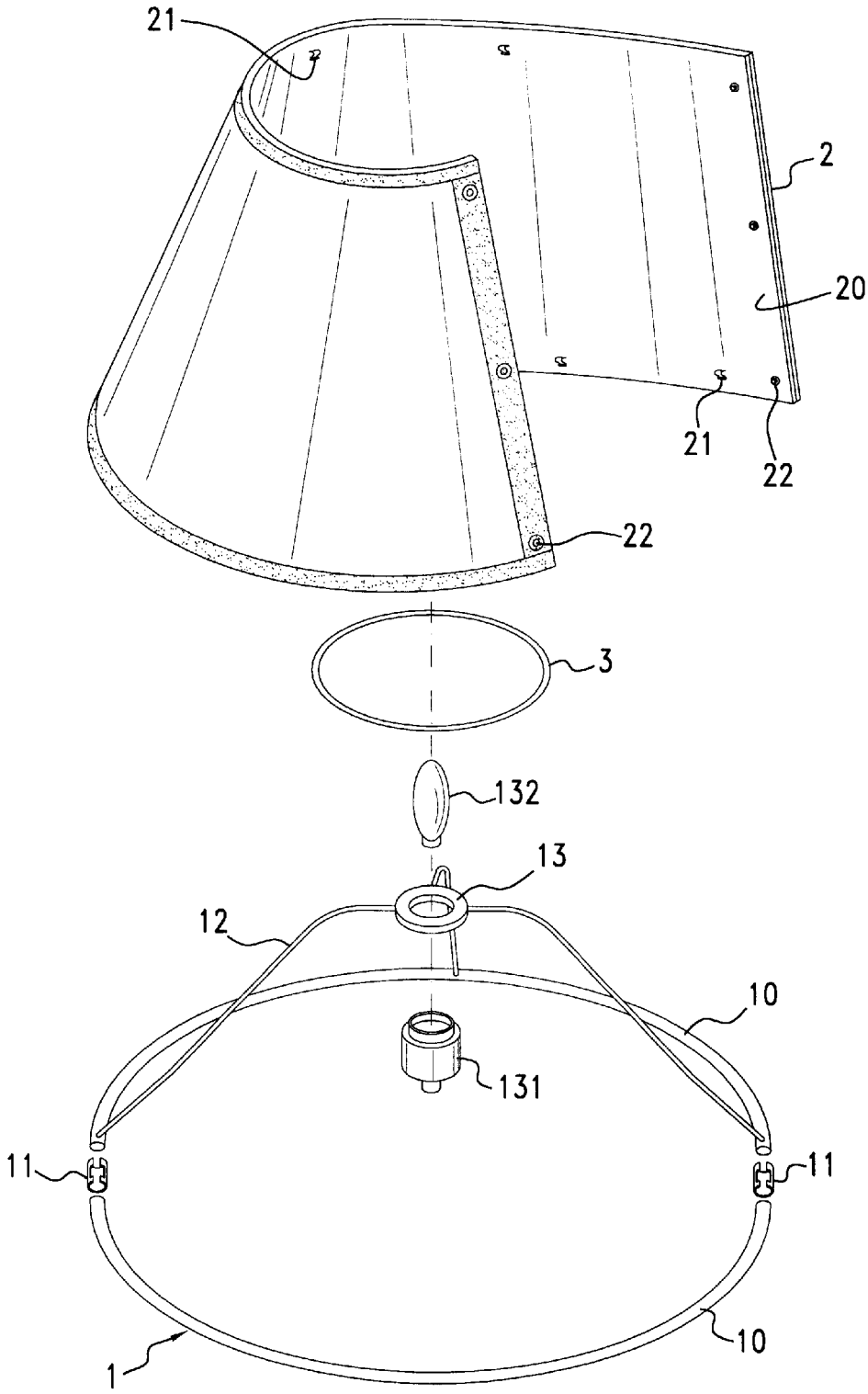
FIG. 1 is a knocked-down view of the lampshade structure of the present invention.
Figure 2:
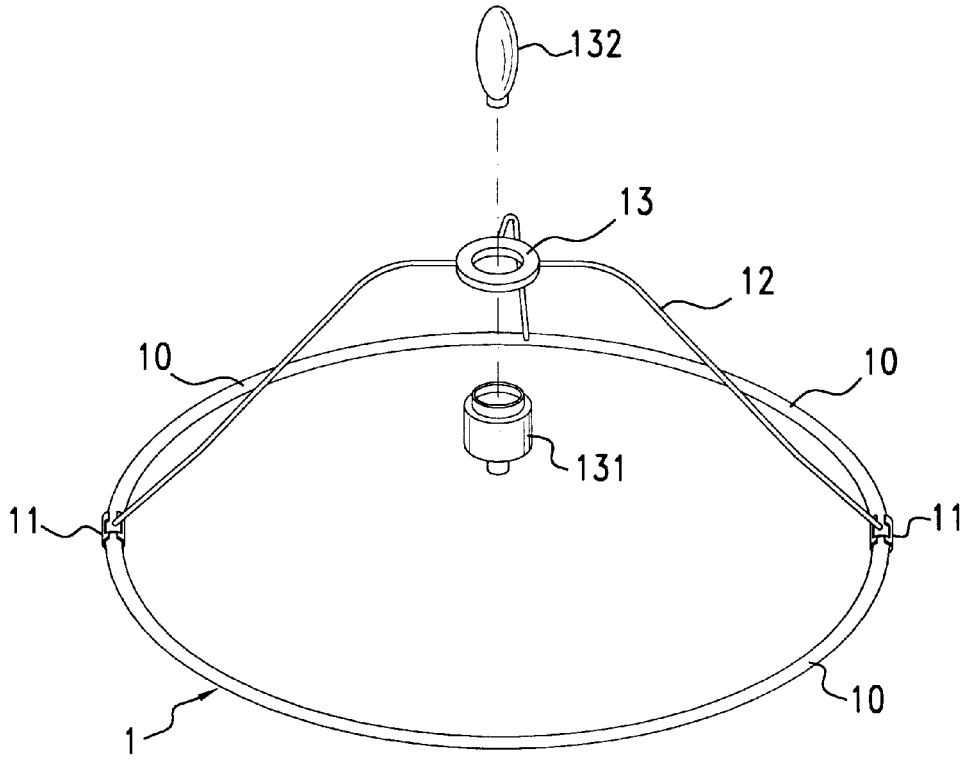
FIG. 2 is an embodiment view of the lampshade structure of the present invention.

Please refer to FIGS. 1 to 4B. The knockdown lampshade structure of the present invention includes a frame body (1), a shade body (2) and a circular frame (3) embracing the lampshade.

The frame body (1) compressed of two arch metal frames (10) and multiple joints. The lamp stand (13) is compressed of three support rids (12) which attached to one arch metal frame to form a triangular shape. The lamp base (131) embedded to the lamp stand (13), to support the light bulb (132). As refer to FIG. 2, the arch metal frame can be easily assembled and disassembled allows a minimum volume enable a high efficiency in storage and transfer, hence minimize the required space and cut down the overheads.

Please refer to FIG. 3. The joint (11) is in a "C" shape, which made of hard material, embraced with the arch metal frame (10) enhance the strength of the frame body. As refer to FIGS. 4A and 4B, the shade body (2) is made of soft fabric outside and hard paper material (20) inside in fan-shaped and rolled into a conic shape. The hook (21) is embedded spreading evenly to the top and bottom end of the inner shade body (2) allows handing in glove of the arch metal frame (10) and the circular frame (3) alone the edge of the shade body (2). The clip (22) is embedded alone side of the shade body (2) embracing the frame body (1).

As refer to FIG. 1, the circular frame (3) is a rounded metal, embedded to the top end of the comic shape shade body (2). It is supported by the hook (21), enhances the strength of the shade body (2).

Figure 5:
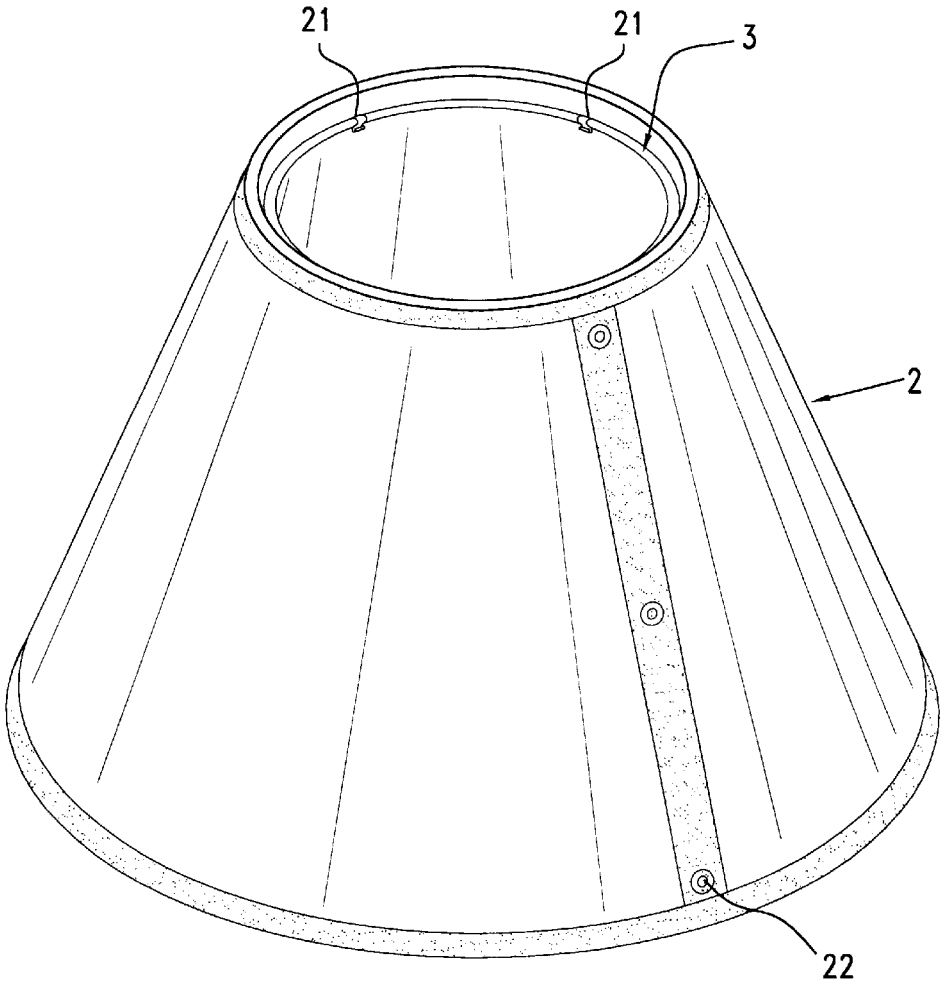
FIG. 5 is an assembled view of the lampshade structure of the present invention.

Accordingly, the present invention knockdown lampshade structure. The frame body (1) is compressed by the joint (11) and two arch metal frames (10). Together with the circular frame (3) that embedded to the shade body (2) by the hook (21) embracing the lampshade (refer to FIG. 5).

Figure 6:
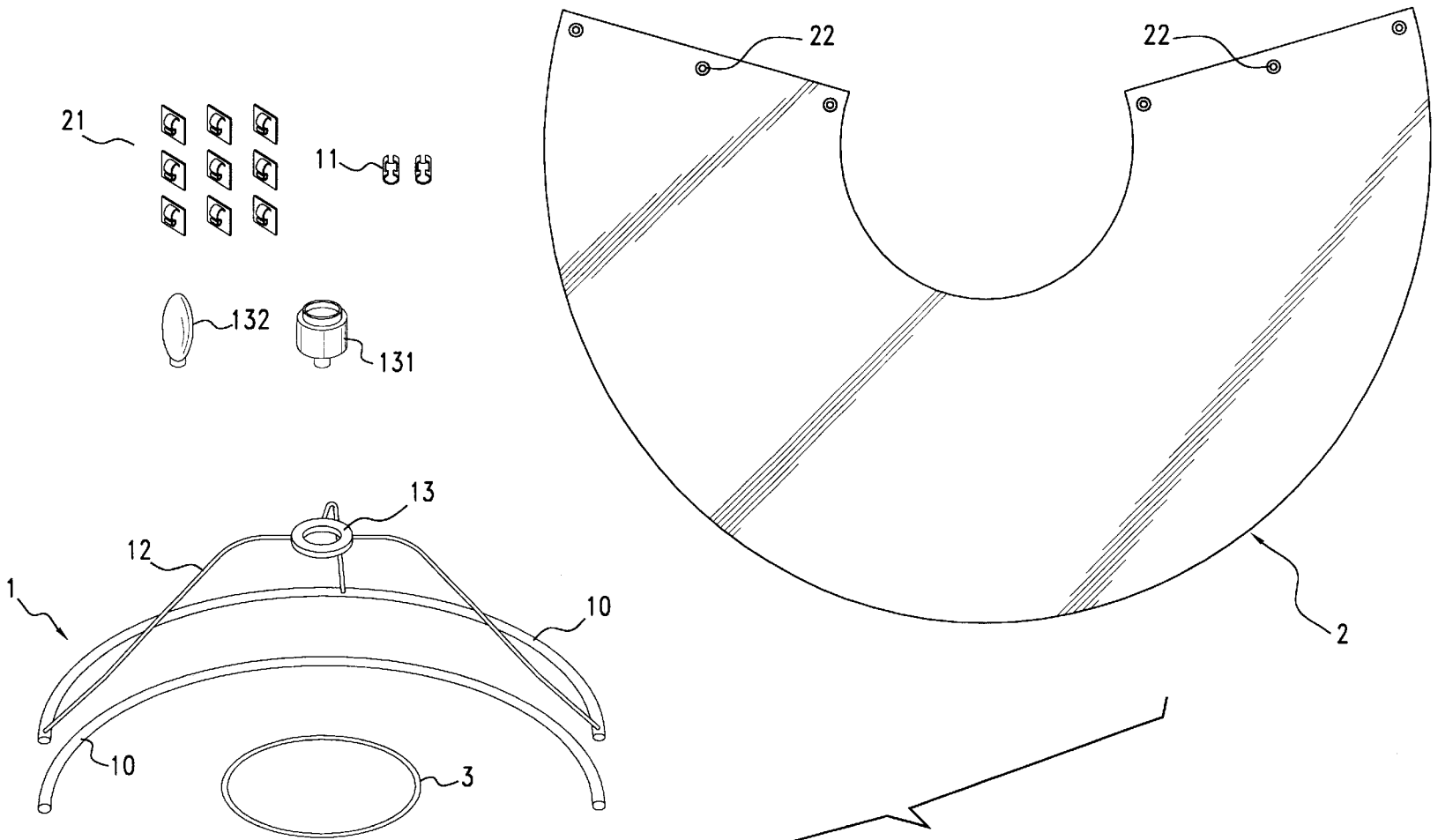
FIG. 6 is an exploded view of the lampshade structure of the present invention.

Please refer to FIG. 6, the exploded view of the lampshade structure of the present invention. The main component is the frame body (1), and includes other components of the arch metal frames (10), the joints (11), the shade body (2) and the circular frame (3). As there components are individual part from each other, allow minimum volume when detached so to facilitate storage and transfer of large amount of products, hence minimize the required space and cut down the production overheads.

Figure 7:
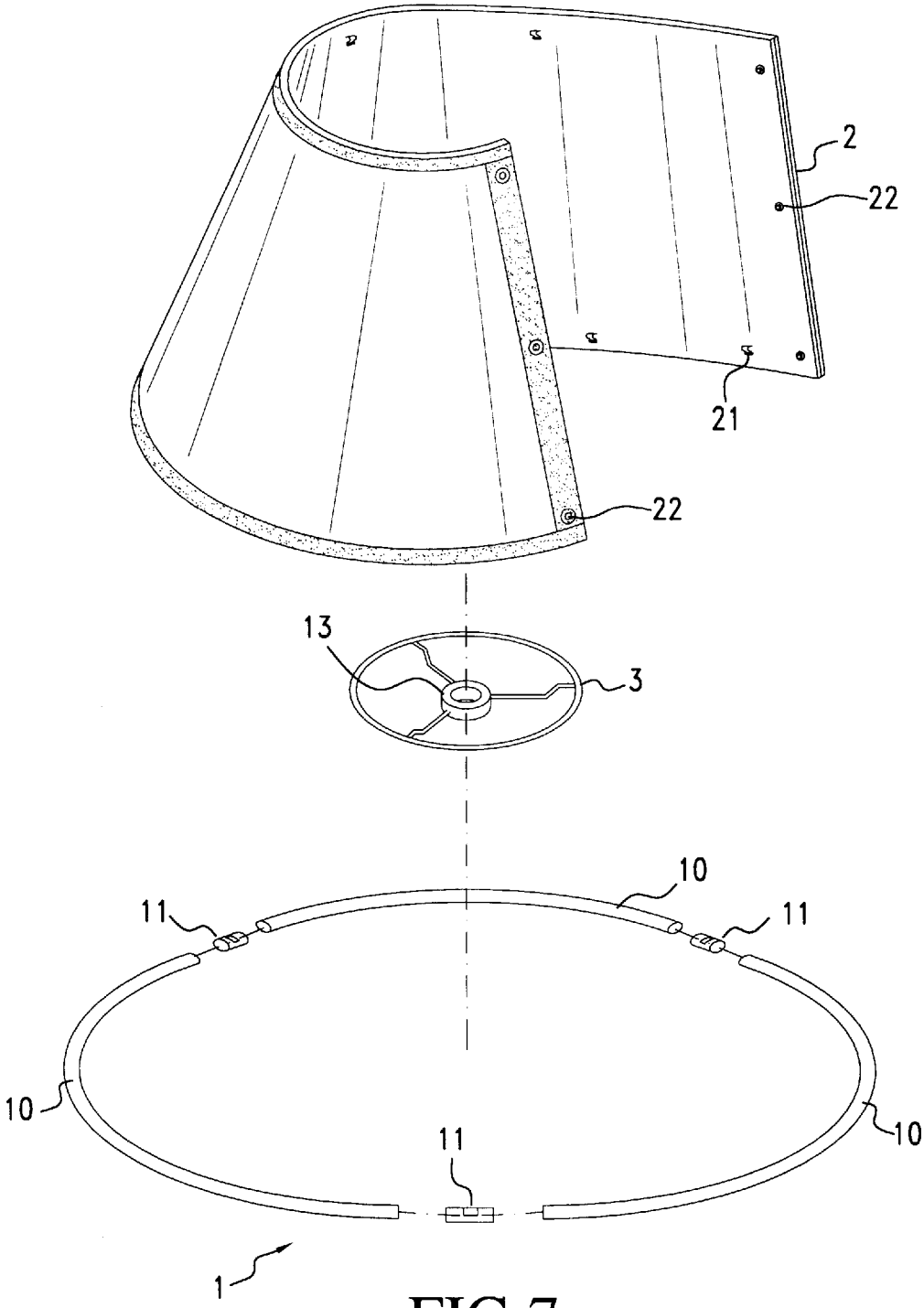
FIG. 7 shows the application of the lampshade structure of the present invention.

Furthermore, in the application of the present invention, can be modified to the other form as refer to FIG. 7. The frame body (1) compressed with only three arch metal frames (10). The lamp stand (13) is then attached to the circular frame (3) to support the lamp base (131) and the light bulb (132). The modified scope of the present invention also meet the objective of facilitate storage and transfer of large amount of products, minimize the occupied space and cut down the overheads.

The above embodiment is only used to illustrate the present invention, not intended to limit the scope thereof. Many modification of the above embodiment can be made without departing from the spirit of the present invention.

SUMMARY OF THE INVENTION

It is therefore a primary object of the present invention to provide a knockdown lamp structure in which the components of the lampshade are easily detachably assembled with each other to form the lampshade. When storing or transferring large amount of lampshades, the lampshades can be disassembled to minimize the occupied space for facilitating storage and transfer of the lampshades without affecting the structural strength or rigidity thereof.

According to the above objective, the knockdown lamp structure. The frame body is embraced with multiple arch metal frames handed in glove by multiple joints. The lamp stand is attached to the arch metal frames to from the frame body. The shade body is in fan-shaded rolled into conic shape which is made of soft fabric outside and hard paper material inside. The shade body is embedded with multiple hook alone the top and bottom end, allows easy assemble and disassemble with the frame body and the circular frame. The shade body is packed in a flat form when storing and transferring hence minimized the occupied volume.

The assembly of the frame body and circular frame is sewn by multiple joints and hooks. Such assembly allows a fast, simple and effective storage and transfer hence meet the objectives of minimize the occupied space and cut down the overheads.

What is claimed is:

1. A knockdown lampshade structure including a frame body, a shade body and a circular frame, the frame body comprises multiple arcuated metal frames joined to each other by joints, three support ribs attached to one of the arcuated metal frames in a triangular shape to form a lamp stand on a top end, the shade body made of soft fabric outside and hard paper material inside in a fan-shape and rolled into a conic shape, a plurality of hooks embedded therein and arranged evenly along the periphery of a top and a bottom end of the inner shade body allowing engagement with the arc metal frame and the circular frame along the edge of the shade body, clips embedded along each side of the shade body embracing the frame body, the circular frame being rounded metal embedded to the top end of the conic shape shade body, and said circular metal frame supported by the hooks to enhance strength of the shade body.

2. A knockdown lampshade structure including a frame body, a shade body and a circular frame, wherein the frame body comprises three arcuated metal frames joined to each other by joints, a lamp stand attached to the circular frame to support the lamp base and a light bulb, the shade body made of soft fabric outside and hard paper material inside in a fan-shape and rolled into a conic shape, a plurality of hooks embedded therein and arranged evenly along the periphery of a top and a bottom end of the inner shade body allowing engagement with the arc metal frame and the circular frame along the edge of the shade body, clips embedded along each side of the shade body embracing the frame body, the circular frame being rounded metal embedded to the top end of the conic shape shade body, and said circular metal frame supported by the hooks to enhance strength of the shade body.

* * * * *